United States Patent [19]

Pietryka

[11] 3,986,547

[45] Oct. 19, 1976

[54] INGOT MOLD

[75] Inventor: Joseph Pietryka, Paris, France

[73] Assignee: Fives-Cail Babcock, Paris, France

[22] Filed: Jan. 3, 1975

[21] Appl. No.: 538,473

Related U.S. Application Data

[63] Continuation-in-part of Ser. No. 348,652, April 6, 1973, abandoned.

[30] Foreign Application Priority Data

Apr. 10, 1972 France ..... 72.12410

[52] U.S. Cl. ..... 164/283 M; 164/348

[51] Int. Cl.[2] ..... B22D 11/124; B22D 27/04

[58] Field of Search..... 285/41, 137 R; 164/89, 164/273 R, 283 R, 283 S, 283 MS, 283 MT, 348

[56] References Cited

UNITED STATES PATENTS

| | | | |
|---|---|---|---|
| 2,108,071 | 2/1938 | Low | 164/283 X |
| 2,424,640 | 7/1947 | Spooner | 164/283 M |
| 2,708,297 | 5/1955 | Zeigler | 164/283 MS |
| 3,381,743 | 5/1968 | Bode | 164/283 M |
| 3,388,737 | 6/1968 | Buckwalter | 164/283 MS |
| 3,682,235 | 8/1972 | Kazeef | 164/283 M |
| 3,685,571 | 8/1972 | Niskovskikh | 164/283 |

*Primary Examiner*—Francis S. Husar
*Assistant Examiner*—John S. Brown
*Attorney, Agent, or Firm*—Kurt Kelman

[57] ABSTRACT

An ingot mold is detachably fixed on an oscillating chassis. A first tubing supplies a fluid cooling medium to the mold and a second tubing is mounted on the oscillating chassis for feeding the cooling medium to the first tubing and for removing it therefrom. Means for interconnecting the first and second tubings comprises a first mount independent of the mold, to which the first tubing is attached, a second mount carried by, but independent of, the chassis, to which the second tubing is attached, and means for attaching the two superposed mounts to each other independently of the means fixing the mold on the chassis.

5 Claims, 2 Drawing Figures

INGOT MOLD

This is a continuation-in-part of my copending application Ser. No. 348,652, filed Apr. 6, 1973, now abandoned.

The present invention relates to improvements in ingot molds.

Ingot molds used in continuous casting operations maybe detachably fixed on an oscillating chassis so that they may readily be removed when it is necessary to repair them or when it is desired to change the shape of the cast ingot. Since such ingot molds are cooled by circulating cold water or a like fluid cooling medium through a tubing supplying the medium to the mold, it is necessary to provide detachable connections between this first tubing and a second tubing mounted on the oscillating chassis for feeding the cooling medium to the first tubing and for evacuating the same therefrom.

Rapid assembly and disassembling has been made possible by providing an oscillating chassis in the form of a hollow frame divided into several chambers each connected to different fixed fluid supply and evacuation tubes by flexible hoses, and the mold elements have been mounted on a hollow frame of the same dimensions as the chassis frame. Suitable connecting means detachably fix the mold frame on the chassis frame, the mold frame being equally divided into several chambers connected to different elements of the mold and communicating with the corresponding chambers of the oscillating chassis through ports in the contacting faces of the two frames. Suitable gaskets are mounted about the ports to assure a fluid-tight joint when the two frames are pressed together.

When the dimensions of the frames are large, for instance in the casting of ingots whose width may be as much as two yards, it is difficult to attain perfect fluid tightness all around because of the deformation of the frames.

It is the primary object of this invention to overcome these and other difficulties in the detachable mounting of water-cooled ingot molds on their oscillating chassis, for the rapid assembly and disassembly of the mold.

This and other objects are accomplished in accordance with the invention with a means for interconnecting the first and second tubings, which comprises a first mount independent of the mold, to which the first tubing is attached. A second mount may be carried by, but normally independent of, the chassis, and the second tubing is attached to the second mount. The mounts are attached to each other in superposed relationship by means independent of the means fixing the mold on the oscillating chassis.

Figure 2:
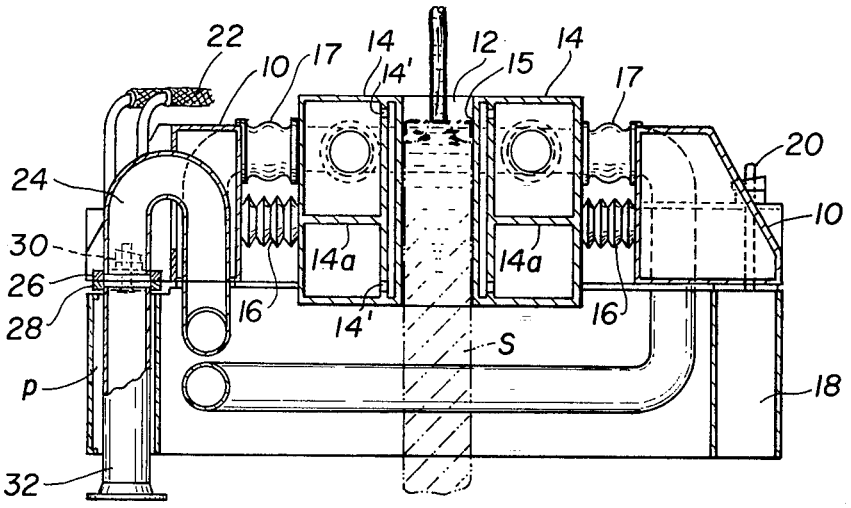
Figure 1:
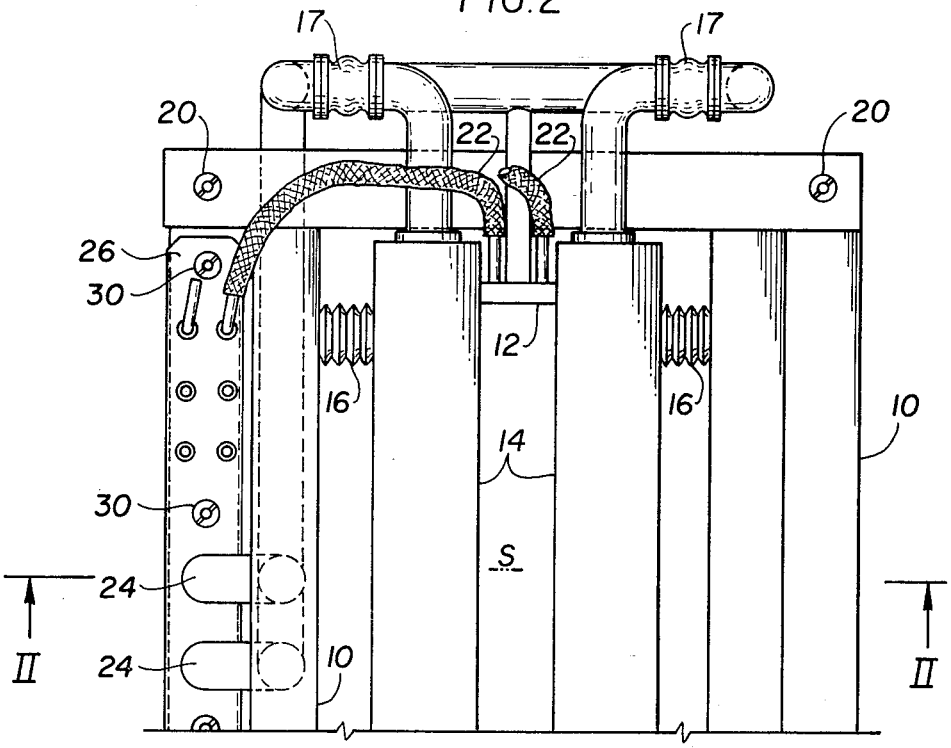

The above and other objects, advantages and features of the present invention will become more apparent from the following detailed description of a now preferred embodiment thereof, taken in conjunction with the accompanying drawing wherein:

FIG. 1 is a plan view showing half of an ingot mold according to this invention; and FIG. 2 is a section along lines II—II of FIG. 1.

Referring now to the drawing, there is shown a hollow, rectangular frame 10 within whose perimeter there are mounted four panels constituting the four faces or walls of the mold. Panels 12 constituting the small faces are tightly held between panels 14 constituting the large faces by resilient pressure elements 16 wedged between the mold panels 14 and the frame 10.

The illustrated pressure elements are comprised of frusto-conical elastic discs aligned between panels 14 and adjacent walls of frame 10. Ingot S is continuously cast in the mold defined by panels 12 and 14.

Dowel and pin connecting means 20 detachably fix the mold frame 10 on oscillating chassis 18 also constituted by a hollow frame. The illustrated detachable mounting of mold frame 10 on oscillating chassis 18 comprises, at each corner of the chassis and frame, a dowel welded to the chassis and passing through registering holes in frame 10, each dowel having a slot at its protruding upper end and receiving a wedged cotter pin.

The frame 10 and four faces 12, 14 of the mold are cooled by the circulation of cold water which is fed to panels 12 and is removed or evacuated therefrom by flexible hoses 22. Sheet metal tubes 24 having a reversed U-shape are used to feed the water through mold frame 10 to and from panels 14. Such cooling systems for ingot molds are generally well known and form no part of the present invention which deals with the connection of the cooling system.

Hoses 22 and tubes 24 constitute first tubing for supplying a fluid cooling medium, such as water, to the mold panels for cooling the same and for evacuating the medium therefrom, and vertical tubes 32 constitute a second tubing mounted within the oscillating chassis for feeding the fluid cooling medium to the first tubing and for evacuating the same therefrom. In operation, the first and second tubings must be interconnected to permit the cooling medium to circulate through the mold panels for cooling the faces of the mold.

In accordance with the present invention, the means for interconnecting the tubings comprises a first flange or mount 26 to which hoses 22 and tubes 24 are attached. This mount is constituted by manifold flange 26 which is a flat plate having a plurality of bores communicating with respective ones of hoses 22 and tubes 24. This elongated rectangular flange is independent of the mold, i.e. it is mounted independently of any of the mold parts, and is illustrated herein as being disposed parallel to a large side of the frame and the mold panels 14 at the level of the inferior face of frame 10. Flange 26 is supported solely by tubes 24 to whose outer ends the mount is welded. Tubes 24 being of sheet metal and U-shaped, as shown in FIG. 2, they are of sufficient flexibility or resiliency to permit a slight displacement of flange 26 parallel and perpendicularly to its plane.

FIG. 1 shows two tubes 24 serving to supply a fluid cooling medium to mold panels 14 for cooling the large faces of the mold. As shown in FIG. 2, these panels consist of hollow sheet metal boxes or casings divided into two compartments by dividing wall 14*a*. The large faces of the mold in contact with the cast metal are constituted by copper plates 15 affixed to panels 14 and slightly spaced therefrom to provide a jacket through which the cooling medium may circulate. Ports 14′ in the panel wall facing the copper plate provide communication between the panel compartments and the jacket. AS shown, the two illustrated tubes 24 extend from flange 26 to the upper compartments in panels 14 to supply cooling water thereto, the cooling water passing through upper ports 14′ into the jacket for cooling the large faces of the mold, and leaving the jacket through lower ports 14′ to enter the lower panel compartments whence they are evacuated through two like tubes (not shown) which extend from the opposite panel walls to flange 26 at the half of the apparatus not shown in FIG. 1. Removably and exchangeable expansion sleeves or joints 17 are mounted in tubes 24 between flange 26 and the mold panels to permit the length of the tubing to be changed in accordance with any change in the dimensions of the mold. For proper support, tubes 24, which pass though hollow frame 10, are welded to the frame.

Similarly, two hoses 22 are also connected to flange 26 to supply the cooling water to mold panels 12 for cooling the small faces of the mold, as shown in FIG. 1, the cooling water circulation being similar to that described hereinabove in connection with panels 14 and the evacuating hoses not being shown. Additional connections for additional hoses are shown on flange 26 for circulating water to pulverizing devices carried by, and under, the mold (not shown).

A second and like flange or mount 28 forms a second part of the interconnecting means and is normally independent of, oscillating chassis 18, i.e. flange 28 is not affixed to the chassis. Vertical tubes 32 are attached to flange 28 in the same manner as tubes 24 are attached to flange 26, the two bridges being in superposed relationship.

The third part of the means for interconnecting first tubing 22, 24 and second tubing 32 comprises attaching means 30 consisting of a dowel-and-pin connection similar to that of connection 20 but independent thereof.

Since flange 28 is not directly connected to chassis 18, it may be removed from the chassis 18 with the second tubing attached thereto. When the dowel-and-pin connections 30 are detached, there is no connection between the two flanges and flange 28 may rest on chassis 18.

Vertical tubes 32 are attached to flange 28 in alignment with tubes 24 for communication therebetween and are mounted with some play in vertical passages P of the chassis 18 to permit tubes 32 to glide in their guide passages. Other tubing (not shown) is similarly attached to flange 28 in alignment with hoses 22 for communication therewith so as to supply the cooling medium to small panels 12 and evacuate the same therefrom.

Watertight gaskets are compressed between the two attached flanges around the orifices thereof to assure a tight connection between the aligned tubings.

This arrangement permits perfect fluid tightness between the mounts since they can orient themselves freely in respect of their supports because the connecting means 30 between the tubing mounts are independent from the connecting means 20 between the mold and the chassis. Under these conditions, the connecting pressure between the mounts cannot be modified by deformations of the mold and/or chassis frames.

It will be understood that the mounts may be connected to the mold and chassis frames, respectively, by means other than those described and illustrated as long as they assure a flexible connection or a connection permitting some play so that the mounts may move freely in respect of their supports to a certain extent, and they are capable of supporting the mounts when the mold and chassis are separated. One of the mounts could be rigidly fixed to its supports if the other mount has more play. It is also possible to connect the mounts to their supports so that one of the mounts can be displaced only in its plane while the other is displaceable solely perpendicularly to its plane.

What is claimed is:

1. An ingot mold comprising:

1. an oscillating chassis;

2. an ingot mold;

3. means for detachably fixing said mold to the chassis;

4. first tubing attached to said mold for supplying a fluid cooling medium to the mold and for evacuating the medium therefrom;

5. second tubing feeding the cooling medium to the first tubing and evacuating the same therefrom;

a. said first tubing being flexible,

6. means interconnecting the first and second tubings, the interconnecting means including a. a first mount attached to said first tubing and supported thereby, b. a second mount attached to said second tubing, and c. means releasably attaching said mounts to each other and constituting the sole connection between the attached second mount to said mold.

2. The ingot mold as set forth in claim 1, further comprising guide means on said chassis for guiding movement of said second tubing.

3. The ingot mold of claim 1, wherein the oscillating chassis has an upper face, the ingot mold comprises a horizontal frame mounted on the upper chassis face, the mounts are superimposed substantially in the plane of the upper chassis face, the first tubing comprises a U-shaped tube having one branch attached to the upper one of the mounts and the other branch to the horizontal frame of the mold, the tube supporting the mount, and the second tubing comprises a vertical tube attached to the lower one of the mounts.

4. The ingot mold of claim 1, wherein the first tubing includes an inverted U-shaped tube having one branch attached to the upper one of the mounts and supporting the upper mount and the other branch to the horizontal frame of the mold.

5. The ingot mold of claim 1, wherein the second tubing comprises vertical tubes attached to the second mount and received with play in vertical passages in the oscillating chassis.

* * * * *